US012735798B2

(12) United States Patent
Khy et al.

(10) Patent No.: US 12,735,798 B2
(45) Date of Patent: Sep. 15, 2026

(54) ALKALINE ELECTROLYSIS ARRANGEMENT WITH DEAERATOR AND METHOD THEREFOR

(71) Applicant: L'Air Liquide Société Anonyme pour l'Etude et l'Exploitation des Procédés Georges Claude, Paris (FR)

(72) Inventors: Marie-Khuny Khy, Champigny-sur-Marne (FR); Maxime Butler, Champigny-sur-Marne (FR); Marie Portier, Paris (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 705 days.

(21) Appl. No.: 17/974,069

(22) Filed: Oct. 26, 2022

(65) Prior Publication Data

US 2023/0131407 A1 Apr. 27, 2023

(30) Foreign Application Priority Data

Oct. 26, 2021 (EP) ..... 21020527

(51) Int. Cl.
*C25B 15/08* (2006.01)
*C25B 1/04* (2021.01)
(Continued)

(52) U.S. Cl.
CPC ..... *C25B 15/085* (2021.01); *C25B 1/04* (2013.01); *C25B 9/67* (2021.01); *C25B 9/77* (2021.01); *C25B 15/083* (2021.01); *C25B 15/087* (2021.01)

(58) Field of Classification Search
CPC ..... C25B 1/04; C25B 1/15–085; C25B 9/67; C25B 9/77; C25B 15/083; C25B 15/087
See application file for complete search history.

(56) References Cited

U.S. PATENT DOCUMENTS

2017/0206991 A1* 7/2017 Manabe ..... C02F 1/04
2022/0290309 A1* 9/2022 Wehrman ..... F04D 29/705
(Continued)

FOREIGN PATENT DOCUMENTS

EP 3 604 617 2/2020
EP 3770304 A1 * 1/2021 ..... C25B 1/04
(Continued)

OTHER PUBLICATIONS

European Search Report and Written Opinion for corresponding EP 21020527.4, Apr. 11, 2022.

*Primary Examiner* — Ciel P Contreras
(74) *Attorney, Agent, or Firm* — Allen E. White; Elwood L. Haynes

(57) ABSTRACT

The invention relates to an electrolysis arrangement for alkaline electrolysis and a method for producing hydrogen and oxygen by electrolysis of an alkaline electrolysis medium. According to the invention, an anolyte deaerating means is arranged downstream of an anolyte gas-liquid separator and is arranged upstream of the electrolysis cell stack of the electrolysis arrangement, and/or a catholyte deaerating means is arranged downstream of a catholyte gas-liquid separator and arranged upstream of the electrolysis cell stack of the electrolysis arrangement. By this arrangement, the fact is exploited that many undesirable gas components have a much lower solubility in the alkaline electrolysis medium than in pure deionised water, which is supplied as fresh water to the electrolysis arrangement for compensation of the water consumed by the electrochemical reaction.

8 Claims, 1 Drawing Sheet

(51) Int. Cl.
*C25B 9/67* (2021.01)
*C25B 9/77* (2021.01)

(56) References Cited

U.S. PATENT DOCUMENTS

2023/0044196 A1* 2/2023 Briglia ..... C25B 15/085
2024/0084460 A1* 3/2024 Kim ..... C25B 15/087

FOREIGN PATENT DOCUMENTS

JP H05 287570 11/1993
WO WO 2021 129566 7/2021

* cited by examiner

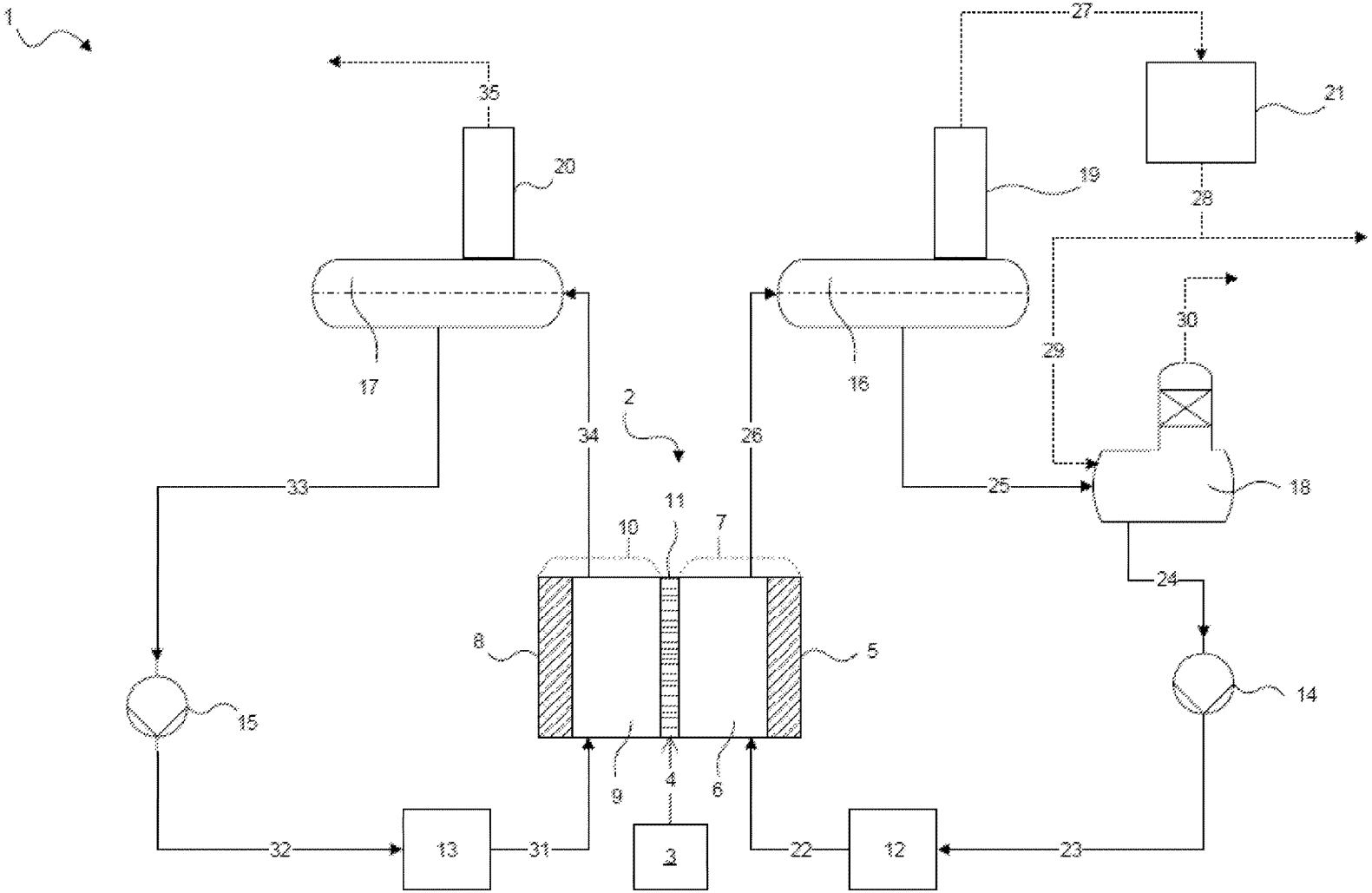
1
2
3
4
5
6
7
8
9
10
11
12
13
14
15
16
17
18
19
20
21
22
23
24
25
26
27
28
29
30
31
32
33
34
35

ALKALINE ELECTROLYSIS ARRANGEMENT WITH DEAERATOR AND METHOD THEREFOR

CROSS REFERENCE TO RELATED APPLICATIONS

This application claims the benefit of priority under 35 U.S.C. § 119 (a) and (b) to European Patent Application No. 21020527.4, filed Oct. 26, 2021, the entire contents of which are incorporated herein by reference.

TECHNICAL FIELD

The invention relates to an electrolysis arrangement for alkaline electrolysis on an industrial scale and a method for producing hydrogen and oxygen by electrolysis of an alkaline electrolysis medium on an industrial scale. The invention further relates to the use of the electrolysis arrangement according to the invention for the removal of Argon from an anolyte and/or catholyte type alkaline electrolysis medium.

BACKGROUND ART

For many industrial applications, for example in the electronics market, hydrogen and oxygen of very high purity is required. For example, there is often the requirement that the Argon content must be reduced to levels of less than 50 ppb (parts per billion).

In general, hydrogen is nowadays produced mainly by the following production methods. First, steam methane reforming followed by purification of the crude hydrogen containing product by pressure swing adsorption (PSA). Second, methanol reforming followed by purification by PSA. And third, by electrolysis of water followed by catalytic purification of the hydrogen product for removal of oxygen and then adsorption purification for the removal of water.

In either of the three cases, the presence of Argon in the purified hydrogen product is caused by the presence of argon in the feedstock to the production process. Either the Argon originates from the natural gas (steam reforming) or methanol (methanol reforming) or from the feed water or steam fed to the electrolyser (electrolysis).

Argon is an impurity that is particularly difficult to remove from hydrogen. To date, there is no effective solution for removing argon from hydrogen. Technologies known today are as follows.

The micro channel palladium membrane technology makes it possible to remove argon to levels of less than one ppb. However, this technology is very expensive and can only be applied for small amounts of hydrogen to be treated.

Cryogenic distillation is also very expensive due to the requirements to energy and equipment, as the starting materials have to be cooled to extremely low temperatures.

Another technique consists in removing the Argon upstream from the feed water by deaeration processes.

According to one technique, the deaeration is effected by the injection of steam or by heating in a water storage tank to reduce the content of dissolved gases of the feed water. This kind of technique is commonly used in the generation of hydrogen by reforming in order to remove oxygen from water that is used to produce steam.

According to a further technique, deaeration is effected by injecting a small amount of pure hydrogen into the feed water to vaporize a portion of the dissolved gases by displacement.

However, the aforementioned techniques do not make it possible to achieve the degrees of purity required e.g. in electronics applications.

Furthermore, at least some of the aforementioned technologies are complex and expensive and cannot be applied on an industrial scale.

SUMMARY

It is a general object of the present invention to provide a device and/or method which at least in part overcomes the problems of the prior art.

In particular, it is a general object of the present invention to provide an electrolysis arrangement which at least in part overcomes the problems of the prior art.

It is a further object of the present invention to provide an electrolysis arrangement which provides a hydrogen product with low Argon content.

It is a further object of the present invention to provide an electrolysis arrangement which provides an oxygen product with low Argon content.

It is a further object of the present invention to provide an electrolysis arrangement which provides an alternative to the aforementioned techniques to lower the proportion of undesirable gas components in the gas to be produced.

In particular, it is a further object of the present invention to provide an electrolysis arrangement which provides an alternative to the aforementioned techniques to lower the proportion of gases which are not hydrogen in the hydrogen product.

In particular, it is a further object of the present invention to provide an electrolysis arrangement which provides an alternative to the aforementioned techniques to lower the proportion of gases which are not oxygen in the oxygen product.

In particular, it is a further object of the present invention to provide an electrolysis arrangement which provides an alternative to the aforementioned techniques to lower the Argon content in the hydrogen product.

In particular, it is a further object of the present invention to provide an electrolysis arrangement which provides an alternative to the aforementioned techniques to lower the Argon content in the oxygen product.

It is a further object of the present invention to provide a use of an electrolysis arrangement which at least partially solves at least one of the aforementioned problems.

It is a further object of the present invention to provide a method which at least partially solves at least one of the aforementioned problems.

A contribution to the at least partial solution of at least one of the above mentioned objects is provided by the subject-matter of the independent claims. The dependent claims provide preferred embodiments which contribute to the at least partial solution of at least one of the objects. Preferred embodiments of elements of a category according to the invention shall, if applicable, also be preferred for components of same or corresponding elements of a respective other category according to the invention.

The terms "having", "comprising" or "containing" etc. do not exclude the possibility that further elements, ingredients etc. may be comprised. The indefinite article "a" or "an" does not exclude that a plurality may be present.

In general, at least one of the underlying problems is at least partially solved by an electrolysis arrangement for alkaline electrolysis, comprising an electrolysis cell stack comprising a plurality of electrolysis cells for the electrochemical generation of hydrogen and oxygen from an alkaline electrolysis medium, wherein the electrolysis cell stack comprises an anode section for the generation of oxygen and a cathode section for the generation of hydrogen;

an anolyte gas-liquid separator configured for the separation of oxygen gas from an oxygen loaded anolyte portion of the alkaline electrolysis medium;

a catholyte gas-liquid separator configured for the separation of hydrogen gas from a hydrogen loaded catholyte portion of the alkaline electrolysis medium;

an anolyte cooling means arranged downstream of the anolyte gas-liquid separator and upstream of the electrolysis cell stack, configured to cool an oxygen depleted anolyte withdrawn from the anolyte gas-liquid separator before the oxygen depleted anolyte is supplied to the electrolysis cell stack and/or a catholyte cooling means arranged downstream of the catholyte gas-liquid separator and upstream of the electrolysis cell stack, configured to cool a hydrogen depleted catholyte withdrawn from the catholyte gas-liquid separator before the hydrogen depleted catholyte is supplied to the electrolysis cell stack;

an anolyte deaerating means arranged downstream of the anolyte gas-liquid separator and arranged upstream of the electrolysis cell stack and/or a catholyte deaerating means arranged downstream of the catholyte gas-liquid separator and arranged upstream of the electrolysis cell stack.

As known to the skilled person, the electrolysis cell stack is supplied with direct current from a direct current source, in particular a rectifier, to effect the electrochemical water splitting reaction in the electrolysis cell stack. The unit consisting of an electrolysis cell stack and a direct current source is also referred to as the electrolyser. Hence, according to one embodiment, the electrolysis arrangement comprises a direct current source configured to supply direct current to the electrolysis cell stack.

Furthermore, also as known to the skilled person, the electrolysis arrangement comprises a water supply to supply the electrolysis arrangement with deionised water to compensate for the water which is consumed by the electrochemical water splitting reaction in the electrolysis cell stack. Hence, according to one embodiment, the electrolysis arrangement comprises a water source to supply deionised water to the electrolysis arrangement to compensate for the water consumed by electrolysis.

The "electrolysis medium" may also be referred to as "electrolyte". The electrolyte of the anode side of the electrolysis arrangement, where oxidation occurs, is referred to as the "anolyte", whereas the electrolyte of the cathode side of the electrolysis arrangement, where reduction occurs, is referred to as the "catholyte"

According to the invention, an anolyte deaerating means and/or a catholyte deaerating means is arranged downstream of the anolyte gas-liquid separator respectively the catholyte gas-liquid separator and upstream of the electrolysis cell stack. In other words, the anolyte deaerating means and/or catholyte deaerating means is arranged between the respective gas-liquid separator and the electrolysis cell stack. That is, the hydrogen depleted catholyte withdrawn from the catholyte gas-liquid separator will be deaerated and then supplied to the cathode section of the electrolysis cell stack. Correspondingly, the oxygen depleted anolyte withdrawn from the anolyte gas-liquid separator will be deaerated and then supplied to the anode section of the electrolysis cell stack. Hence, according to one embodiment, the anolyte deaerating means is arranged downstream of the anolyte gas-liquid separator and arranged upstream of the anode section of the electrolysis cell stack. Correspondingly, the catholyte deaerating means is arranged downstream of the catholyte gas-liquid separator and arranged upstream of the cathode section of the electrolysis cell stack.

The invention exploits the fact that many undesirable gas components have a much lower solubility in the alkaline electrolysis medium than in pure deionised water, which is supplied as fresh water to the electrolysis arrangement. In particular, at equilibrium at 1 bar and 20° C., the fraction of Argon soluble in pure water is 259 ppb, whereas it is only 15 ppb under the same conditions in a concentrated aqueous lye solution of 30 wt.-% KOH (potassium hydroxide) in water. Deaerating the alkaline electrolysis medium is therefore easier and results in a lower amount of undesirable dissolved gas components than deaerating the deionised fresh water supplied to the electrolysis arrangement. The lower the amount of undesired dissolved gas components in the electrolyte (anolyte or catholyte) supplied to the electrolysis cell stack, the lower the amount of undesired gas components in the product gas (hydrogen or oxygen).

The term "deaerating means" in the context of objects of the invention means a unit or device configured to remove undesired dissolved gas components from the respective electrolyte type (anolyte or catholyte) which do not correspond to the gas to be produced, which means in particular hydrogen on the cathode side and oxygen on the anode side of the electrolysis arrangement. In particular, the "deaerating means" is a deaerator. The "deaerating means" may also be referred to as "degassing means". A "deaerator" may also be referred to as "degasser". The same applies, with the necessary adjustments, to the term "deaerating" or "degassing", whereby the term "deaerating" is to be understood in the same way as the term "degassing".

The aforementioned components of the electrolysis arrangement, particularly the electrolysis cell stack, the anolyte gas-liquid separator, the catholyte gas-liquid separator, the anolyte cooling means and/or the catholyte cooling means, and the anolyte deaerating means and/or the catholyte deaerating means are in fluid communication with each other. In particular, the hydrogen loaded catholyte generated in the cathode section of the electrolysis cell stack is introduced into the catholyte gas-liquid separator, in which hydrogen gas is separated from the hydrogen loaded catholyte. The hydrogen loaded catholyte is a two-phase system (gas/liquid), from which the gaseous phase, namely hydrogen gas, is separated. The hydrogen gas is withdrawn from the catholyte gas-liquid separator. The remaining hydrogen depleted catholyte still contains dissolved and in particular undesired dissolved gases. Hence, the hydrogen depleted catholyte is subsequently withdrawn from the catholyte gas-liquid separator and sent to the catholyte deaerating means, which is configured for deaerating or degassing the hydrogen depleted catholyte. The degassed or deaerated hydrogen depleted catholyte is afterwards introduced to the cathode section of the electrolysis cell stack for the renewed generation of hydrogen in the cathode section of the electrolysis cell stack. In particular, the oxygen loaded anolyte generated in the anode section of the electrolysis cell stack is introduced into the anolyte gas-liquid separator, in which oxygen gas is separated from the oxygen loaded catholyte. The oxygen loaded catholyte is a two-phase system (gas/liquid), from which the gaseous phase, namely oxygen gas, is separated. The oxygen gas is withdrawn from the anolyte gas-liquid separator. The remaining oxygen depleted anolyte still contains dissolved and in particular undesired dissolved gases. Hence, the oxygen depleted anolyte is subsequently withdrawn from the anolyte gas-liquid separator and sent to the anolyte deaerating means, which is configured for deaerating or degassing the oxygen depleted anolyte. The degassed or deaerated oxygen depleted anolyte is afterwards introduced to the anode section of the electrolysis cell stack for the renewed generation of oxygen in the anode section of the electrolysis cell stack. The electrolysis arrangement according to the invention may comprise either an anolyte deaerating means only, a catholyte deaerating means only or both an anolyte deaerating means and a catholyte deaerating means.

According to one embodiment, the electrolysis arrangement comprises a mixing device arranged downstream of the anolyte deaerating means and/or the catholyte deaerating means. In such an arrangement, the degassed oxygen depleted anolyte and/or the degassed hydrogen depleted catholyte are at least partially mixed after deaeration to balance unequal lye concentrations in the anolyte and the catholyte. The resulting mixed electrolyte is afterwards split, whereby one portion is introduced into the anode section of the electrolysis cell stack and one portion is introduced into the cathode section of the electrolysis cell stack.

According to one embodiment, the electrolysis arrangement comprises a mixing device arranged upstream of the anolyte deaerating means and/or the catholyte deaerating means. In such an arrangement, the oxygen depleted anolyte and the hydrogen depleted catholyte are first at least partially mixed to balance unequal lye concentrations in the anolyte and catholyte and afterwards deaerated by the anolyte and/or catholyte deaerating means. The resulting mixed electrolyte stream is afterwards divided into two portions, whereby one portion is introduced into the anode section of the electrolysis cell stack and one portion is introduced into the cathode section of the electrolysis cell stack. According to this arrangement, the anolyte deaerating means and the catholyte deaerating means may form one single unit or deaerator, and said deaerator is arranged upstream of the point where the mixed electrolyte stream is divided. In this case, the anolyte and the catholyte deaerating means may be referred to as combined anolyte and catholyte deaerating means or mixed electrolyte deaerating means. In particular, the combined anolyte and catholyte deaerating means is a combined anolyte and catholyte deaerator. In particular, the mixed electrolyte deaerating means is a mixed electrolyte deaerator.

An anolyte cooling means can be arranged downstream of the anolyte gas-liquid separator and upstream of the electrolysis cell stack, in particular the anode section of the electrolysis cell stack. The anolyte cooling means is configured to cool the anolyte, that is the anolyte is cooled to a set target temperature. In particular, the anolyte cooling means is an anolyte cooler or anolyte cooling means. By the electrochemical splitting of water, electrical energy is partially converted into heat energy, which is dissipated by the anolyte cooling means.

A catholyte cooling means can be arranged downstream of the catholyte gas-liquid separator and upstream of the electrolysis cell stack, in particular the cathode section of the electrolysis cell stack. The catholyte cooling means is configured to cool the catholyte, that is the catholyte is cooled to a set target temperature. In particular, the catholyte cooling means is a catholyte cooler or catholyte cooling unit. By the electrochemical splitting of water, electrical energy is partially converted into heat energy, which is dissipated by the catholyte cooling means.

The electrolysis arrangement according to the invention may comprise either an anolyte cooling means only, a catholyte cooling means only or both an anolyte cooling means and a catholyte cooling means. The anolyte cooling means and the catholyte cooling means may also be realised as a single unit, in which both the oxygen depleted anolyte and the hydrogen depleted catholyte are cooled. Such a unit may be referred to as combined anolyte and catholyte cooling means. In case the electrolysis arrangement comprises a mixing device to at least partially mix the oxygen depleted anolyte and the hydrogen depleted catholyte, only one single cooler or cooling unit may be required. Such a cooler or cooling unit may be referred to as combined anolyte and catholyte cooling means or mixed electrolyte cooling means.

According to one embodiment of the electrolysis arrangement, the alkaline electrolysis medium is a concentrated lye solution, in particular a concentrated aqueous lye solution, in particular an aqueous KOH solution with a concentration of up to 30 wt.-%, or up to 35 wt.-%, or up to 40 wt.-%.

According to one embodiment of the electrolysis arrangement, the anolyte deaerating means is arranged downstream of the anolyte gas-liquid separator and is arranged upstream of the anolyte cooling means and/or the catholyte deaerating means is arranged downstream of the catholyte gas-liquid separator and is arranged upstream of the catholyte cooling means.

That is, the anolyte deaerating means and/or the catholyte deaerating means is/are preferably arranged between the anolyte gas-liquid separator and/or the catholyte gas-liquid separator and the anolyte cooling means and/or the catholyte cooling means. The degassing of the anolyte and/or catholyte is improved at higher temperatures of the alkaline electrolyte, as the solubility of the undesired gases decreases with the temperature.

According to one embodiment of the electrolysis arrangement, an anolyte recirculation pump configured to recirculate anolyte between the anolyte gas-liquid separator and the electrolysis cell stack is arranged downstream of the anolyte deaerating means and upstream of the anolyte cooling means and/or a catholyte recirculation pump configured to recirculate catholyte between the catholyte gas-liquid separator and the electrolysis cell stack is arranged downstream of the catholyte deaerating means and upstream of the catholyte cooling means.

According to one further embodiment of the electrolysis arrangement, the anolyte deaerating means is arranged downstream of the anolyte gas-liquid separator, the anolyte recirculation pump is arranged downstream of the anolyte deaerating means, and the anolyte cooling means is arranged downstream of the anolyte recirculation pump. Additionally or alternatively, the catholyte deaerating means is arranged downstream of the catholyte gas-liquid separator, the catholyte recirculation pump is arranged downstream of the catholyte deaerating means, and the catholyte cooling means is arranged downstream of the catholyte recirculation pump.

According to one embodiment, the electrolysis arrangement comprises a hydrogen purification unit configured for the removal of oxygen and water from the hydrogen gas separated in the catholyte gas-liquid separator, whereby a purified hydrogen gas is obtainable by means of the hydrogen purification unit.

Preferably and according to this embodiment, the hydrogen is purified in two steps. First, oxygen contained in the hydrogen stream (due to membrane crossover or electrolyte mixing) reacts with the hydrogen in a catalyst bed to form water. Second the water thereby formed and water entrained from the gas-liquid separator is removed in a dryer bed, for example by means of molecular sieves.

According to one embodiment of the electrolysis arrangement, the catholyte deaerating means is configured for the degassing of the hydrogen depleted catholyte by means of hydrogen gas supplied to the catholyte deaerating means.

This effectively removes undesired gas components from the electrolyte, in particular the catholyte, through the principle of displacement. In other words, by introducing hydrogen in excess, undesired gas components are outgassed from the catholyte and displaced by hydrogen, so that a pure hydrogen product is obtained in the catholyte gas-liquid separator. The degassed undesired gas components are e.g. vented to the atmosphere.

Thereby, according to one embodiment of the electrolysis arrangement, the hydrogen gas supplied to the catholyte deaerating means comprises the purified hydrogen gas obtainable by means of the hydrogen purification unit according to the above mentioned embodiment.

As described above, undesired gas components are removed by introducing hydrogen through displacement. Therefore, it is particularly advantageous if purified hydrogen is used for the degassing process, as then the fewer undesired gases are introduced into the electrolyte, which further increases the purity of the hydrogen product. This configuration has the further advantage that no external hydrogen source is required for the degassing process, the degassing medium can rather be branched off from the internal hydrogen production and purification.

According to one embodiment of the electrolysis arrangement, the anolyte deaerating means is configured for the degassing of the oxygen depleted anolyte by means of oxygen gas supplied to the anolyte deaerating means.

This effectively removes undesired gas components from the electrolyte, in particular the anolyte, through the principle of displacement. In other words, by introducing oxygen in excess, undesired gas components are outgassed from the electrolyte and displaced by oxygen, so that a pure oxygen product is obtained in the anolyte gas-liquid separator. The degassed undesired gas components are e.g. vented to the atmosphere.

According to one embodiment, the electrolysis arrangement comprises an oxygen purification unit configured for the removal of hydrogen and water from the oxygen gas separated in the anolyte gas-liquid separator, whereby a purified oxygen gas is obtainable by means of the oxygen purification unit.

According to one embodiment of the electrolysis arrangement, the oxygen gas supplied to the anolyte deaerating means comprises the purified oxygen gas obtainable by means of the oxygen purification unit according to the above mentioned embodiment.

The advantages according to these configurations correspond, with the appropriate adjustments, to those mentioned above with regard to degassing with pure hydrogen on the cathode side of the electrolysis arrangement.

According to one embodiment of the electrolysis arrangement the anolyte deaerating means and/or the catholyte deaerating means comprises a heating means in order to degas the hydrogen depleted catholyte and/or the oxygen depleted anolyte.

Degassing of the hydrogen depleted catholyte and/or the oxygen depleted anolyte may also be effected by simple heating of the respective electrolyte portion. In one further embodiment, degassing of the hydrogen depleted catholyte and/or the oxygen depleted anolyte is improved, i.e. amplified by heating of the respective electrolyte portion, but the anolyte and/or the catholyte is still mainly degassed by displacement of the undesired gas components by oxygen respectively hydrogen.

In general, at least one of the underlying problems is at least partially solved by an use of at least one embodiment of the electrolysis arrangement for alkaline electrolysis according to the invention, for the removal of Argon from an anolyte and/or catholyte type alkaline electrolysis medium in the production of hydrogen and oxygen by alkaline water electrolysis on an industrial scale.

The electrolysis arrangement according to the invention is in particular useful for the production of hydrogen or oxygen, in particular hydrogen, with low Argon content. In particular, when using the electrolysis arrangement according to the invention, a hydrogen product with an Argon content of less than 50 ppb (v/v, e.g. measured as the volume fraction) can be obtained.

In general, at least one of the underlying problems is at least partially solved by a method for producing hydrogen and oxygen by electrolysis of an alkaline electrolysis medium, the method comprising the method steps of

- electrochemical splitting of water contained in the alkaline electrolysis medium by means of an electrolysis cell stack, whereby a hydrogen loaded catholyte withdrawn from a cathode section of the electrolysis cell stack and an oxygen loaded anolyte withdrawn from an anode section of the electrolysis cell stack are obtained;
- supplying the hydrogen loaded catholyte to a catholyte gas-liquid separator to separate hydrogen from the hydrogen loaded catholyte, whereby hydrogen gas and a hydrogen depleted catholyte are obtained;
- supplying the oxygen loaded anolyte to an anolyte gas-liquid separator to separate oxygen from the oxygen loaded anolyte, whereby oxygen gas and an oxygen depleted anolyte are obtained;
- withdrawing the hydrogen depleted catholyte from the catholyte gas-liquid separator, optionally cooling the hydrogen depleted catholyte and supplying the hydrogen depleted catholyte to the cathode section of the electrolysis cell stack;
- withdrawing the oxygen depleted anolyte from the anolyte gas-liquid separator, optionally cooling the oxygen depleted anolyte and supplying the oxygen depleted anolyte to the anode section of the electrolysis cell stack;
- degassing the hydrogen depleted catholyte withdrawn from the catholyte gas-liquid separator by means of a catholyte deaerating means and supplying the degassed hydrogen depleted catholyte to the electrolysis cell stack and/or degassing the oxygen depleted anolyte withdrawn from the anolyte gas-liquid separator by means of an anolyte deaerating means and supplying the degassed oxygen depleted anolyte to the electrolysis cell stack.

The process steps listed do not necessarily have to be carried out in the order given.

The term "degassing", to be understood in the same way as the term "deaerating", means, in the context of objects of the invention, a process step which has the effect of removing undesired dissolved gas components from the respective electrolyte type (anolyte or catholyte). Undesired gas components do not correspond to the gas to be produced, which means hydrogen on the cathode side and oxygen on the anode side of the electrolysis arrangement.

According to the method according to the invention, hydrogen depleted catholyte withdrawn from the catholyte gas-liquid separator and/or oxygen depleted anolyte withdrawn from the anolyte gas-liquid separator is degassed by means of a catholyte deaerating means and/or by means of an anolyte deaerating means respectively. The degassed catholyte and/or anolyte is afterwards supplied to the electrolysis cell stack.

Again, according to the method of the invention, degassing the alkaline electrolysis medium is easier and results in a lower amount of undesirable dissolved gas components than degassing deionised fresh water supplied to the electrolysis arrangement.

According to one embodiment, the hydrogen depleted catholyte and the oxygen depleted anolyte are at least partially mixed either before or after degassing by the anolyte deaerating means respectively the catholyte deaerating means. The mixing can be done for the purpose of balancing different lye concentrations in the anolyte and the catholyte. In case that the mixing occurs before the degassing, the anolyte deaerating means and the catholyte deaerating means may be one single unit, referred to as combined anolyte and catholyte deaerating means or mixed electrolyte deaerator.

According to one embodiment of the method, the alkaline electrolysis medium is a concentrated lye solution, in particular a concentrated aqueous lye solution, in particular an aqueous KOH solution with a concentration of up to 30 wt.-%, or up to 35 wt.-%, or up to 40 wt.-%.

According to one embodiment of the method, the degassing of the hydrogen depleted catholyte and/or the degassing of the oxygen depleted anolyte is carried out before cooling of the hydrogen depleted catholyte and the oxygen depleted anolyte.

According to this embodiment, the hydrogen depleted catholyte is first degassed, then cooled and then supplied to the cathode section of the electrolysis cell stack and/or the oxygen depleted anolyte is first degassed, then cooled and then supplied to the anode section of the electrolysis cell stack. The degassing of the anolyte and/or catholyte is improved at higher temperatures of the alkaline electrolyte, as the solubility of the undesired gases decreases with the temperature.

According to one embodiment of the method, the hydrogen gas separated in the catholyte gas-liquid separator is withdrawn from said gas-liquid separator and supplied to a hydrogen purification unit for removal of water and oxygen, to obtain a purified hydrogen gas.

Preferably and according to this embodiment, the hydrogen is purified in two steps. First, oxygen contained in the hydrogen stream (due to membrane crossover or electrolyte mixing) reacts with the hydrogen in a catalyst bed to form water. Second, the water thereby formed and water entrained from the gas-liquid separator is removed in a dryer bed, for example by means of molecular sieves.

According to one embodiment of the method, the degassing of the hydrogen depleted catholyte is effected by introducing hydrogen gas into the hydrogen depleted catholyte.

According to this embodiment of the method, undesired gas components from the electrolyte, in particular the catholyte, are removed through the principle of displacement. In other words, by introducing hydrogen in excess, undesired gas components are outgassed from the catholyte and displaced by hydrogen, so that a pure hydrogen product is obtained in the catholyte gas-liquid separator. The degassed undesired gas components are e.g. vented to the atmosphere.

Thereby, according to one embodiment of the method, the degassing of the hydrogen depleted catholyte is effected by introducing purified hydrogen gas into the hydrogen depleted catholyte, wherein the purified hydrogen gas is obtained according to the method embodiment mentioned above.

As described above, undesired gas components are removed by introducing hydrogen through displacement. Therefore, it is particularly advantageous if purified hydrogen is used for the degassing process, as then the fewer undesired gases are introduced into the electrolyte, which further increases the purity of the hydrogen product. This configuration has the further advantage that no external hydrogen source is required for the degassing process, the degassing medium can rather be branched off from the internal hydrogen production und purification.

According to one embodiment of the method, the degassing of the oxygen depleted anolyte is effected by introducing oxygen gas into the oxygen depleted anolyte.

According to this embodiment of the method, undesired gas components from the electrolyte, in particular the anolyte, are removed through the principle of displacement. In other words, by introducing oxygen in excess, undesired gas components are outgassed from the anolyte and displaced by oxygen, so that a pure oxygen product is obtained in the anolyte gas-liquid separator. The degassed undesired gas components are e.g. vented to the atmosphere.

According to one embodiment of the method, the oxygen gas separated in the anolyte gas-liquid separator is withdrawn from said gas-liquid separator and supplied to a oxygen purification unit for removal of water and hydrogen, to obtain a purified oxygen gas.

According to one embodiment of the method, the degassing of the oxygen depleted anolyte is effected by introducing purified oxygen gas into the oxygen depleted anolyte, wherein the purified oxygen gas is obtained according to the method embodiment mentioned above.

The advantages according to these configurations correspond, with the appropriate adjustments, to those mentioned above with regard to degassing with pure hydrogen on the cathode side of the electrolysis arrangement.

According to one embodiment of the method, the degassing of the hydrogen depleted catholyte and/or the degassing of the oxygen depleted anolyte is effected by heating the hydrogen depleted catholyte and/or the oxygen depleted anolyte.

Degassing of the hydrogen depleted catholyte and/or the oxygen depleted anolyte may also be effected by simple heating of the respective electrolyte portion. In one further embodiment of the method, degassing of the hydrogen depleted catholyte and/or the oxygen depleted anolyte is improved, i.e. amplified by heating of the respective electrolyte portion, but the anolyte and/or the catholyte is still mainly degassed by displacement of the undesired gas components by oxygen respectively hydrogen.

BRIEF DESCRIPTION OF THE DRAWING

The invention will now be detailed by way of an exemplary embodiment with reference to the attached drawing. Unless otherwise stated, the drawing is not to scale.

In the FIGURE and the accompanying description, equivalent elements are each provided with the same reference marks.

FIG. 1 depicts a simplified flow diagram of an electrolysis arrangement 1 according to one exemplary embodiment of the invention.

DETAILED DESCRIPTION OF PREFERRED EMBODIMENTS

FIG. 1 depicts one exemplary embodiment of an electrolysis arrangement 1 according to the invention. It is assumed that the electrolysis arrangement 1 performs an alkaline type electrolysis with 30 wt.-% KOH lye solution as the electrolysis medium.

The electrolysis arrangement 1 comprises an electrolysis cell stack 2, a rectifier 3, a catholyte cooler 12, an anolyte cooler 13, a catholyte recirculation pump 14, an anolyte recirculation pump 15, a catholyte gas-liquid separator 16 with hydrogen cooler 19, an anolyte gas-liquid separator 17 with oxygen cooler 20, a catholyte deaerator 18 and a hydrogen purification unit 21. The aforementioned components are at least partially in fluid communication with each other via the conduits 22 to 35. The electrolysis arrangement further comprises a deionised (DI) water supply (not shown) to compensate for the amount of water consumed by the electrochemical water splitting reaction in electrolysis cell stack 2.

Direct current 4 is supplied to the electrolysis cell stack 2 by means of the rectifier 3. For the sake of simplification, only one electrolysis cell is shown in regards of electrolysis cell stack 2, but the electrolysis cell stack 2 actually contains a plurality of electrolysis cells. The electrolysis cell shown comprises an anode section 10, which consists of an anode 8 and an anode compartment 9. The electrolysis cell further comprises a cathode section 7, which consists of a cathode 5 and a cathode compartment 6. The anode section 10 and the cathode section 7 are separated by a liquid tight membrane 11 which enables the exchange of hydroxyl ions between the anode section 10 and the cathode section 7.

By supplying direct current 4 to the electrolysis cell stack 2, water of the electrolyte lye solution is split into hydrogen (cathode side) and oxygen (anode side). This results in the generation of an oxygen loaded anolyte in the anode section 10 of the electrolysis cell stack 2 and a hydrogen loaded catholyte in the cathode section 7 of the electrolysis cell stack 2.

On the cathode side of the electrolysis arrangement 2, hydrogen loaded catholyte is withdrawn from the cathode section 7 of the electrolysis cell stack and sent via conduit 26 to cathode gas-liquid separator 16. In catholyte gas-liquid separator 16, hydrogen gas is separated from the hydrogen loaded catholyte, whereby an hydrogen depleted catholyte and hydrogen gas is obtained. The hydrogen gas contains uncondensed water. Hence, it is cooled in hydrogen cooler 19 of catholyte gas-liquid separator 16 by indirect cooling. Therefore, hydrogen cooler 19 is supplied with cooling water (not shown). The thereby condensed water is returned to the catholyte gas-liquid separator 16. Heated cooling water is withdrawn from hydrogen cooler 16 and re-cooled by e.g. an air cooler (not shown). Mostly dry hydrogen gas is withdrawn from the hydrogen cooler 19 part of the catholyte gas-liquid separator 16 and is then sent via conduit 27 to the hydrogen purification unit 21. The hydrogen gas withdrawn from hydrogen cooler 19 contains residual amounts of water and oxygen, the latter from oxygen crossover from the anode section 10 to the cathode section 7 of the electrolysis cell stack 2 through membrane 11. In hydrogen purification unit 21, the oxygen contained in the hydrogen gas is first reacted with a small amount of hydrogen on a catalyst bed (not shown) to form water. The formed water and residual water of the hydrogen stream is then removed in an adsorption bed containing molecular sieves. The obtained pure hydrogen stream is withdrawn from the hydrogen purification unit 21 via conduit 28 and is then discharged from the process for further processing.

Hydrogen depleted catholyte formed in catholyte gas-liquid separator 16 is withdrawn from catholyte gas-liquid separator 16 via conduit 25 and is sent to catholyte deaerator 18. From the purified hydrogen gas main stream of conduit 28, a small side stream is withdrawn and sent via conduit 29 to catholyte deaerator 18. In catholyte deaerator 18, hydrogen depleted catholyte is degassed by the pure hydrogen introduced into deaerator 18 through the principle of displacement. That is, undesired gas components, e.g. Argon, dissolved in the hydrogen depleted catholyte are displaced in catholyte deaerator through the introduction of hydrogen gas into the hydrogen depleted catholyte. The undesired and desorbed gas components are then vented from the catholyte deaerator 18 via conduit 30.

To make the degassing process in catholyte deaerator 18 more effective, catholyte deaerator 18 can optionally be equipped with a heating device (not shown).

The degassed hydrogen depleted catholyte is withdrawn from catholyte deaerator 18 via conduits 24 and 23 and sent to catholyte cooler 12. Between conduits 23 and 24, the catholyte recirculation pump is arranged to recirculate the catholyte between the cathode section 7 of the electrolysis cell stack 2, the catholyte gas-liquid separator 16, the catholyte deaerator 18 and the catholyte cooler 12. In catholyte cooler 12, the degassed and hydrogen depleted catholyte is cooled to a pre-determined set temperature and then sent via conduit 22 to the cathode section 7 of the electrolysis cell stack 2 for renewed electrochemical water splitting and formation of hydrogen at the cathode 5.

On the anode side of the electrolysis arrangement 2, oxygen loaded anolyte is withdrawn from the anode section 10 of the electrolysis cell stack and sent via conduit 34 to anode gas-liquid separator 17. In anolyte gas-liquid separator 17, oxygen gas is separated from the oxygen loaded catholyte, whereby an oxygen depleted anolyte and oxygen gas is obtained. The oxygen gas contains uncondensed water. Hence, it is cooled in oxygen cooler 20 of anode gas-liquid separator 17 by indirect cooling. Therefore, oxygen cooler 16 is supplied with cooling water (not shown). The thereby condensed water is returned to the anolyte gas-liquid separator 17. Heated cooling water is withdrawn from oxygen cooler 20 and re-cooled by e.g. an air cooler (not shown). Mostly dry oxygen gas is withdrawn from the oxygen cooler 20 part of the anolyte gas-liquid separator 17 and is then sent via conduit 35 to a further processing step (not shown).

Oxygen depleted anolyte formed in anolyte gas-liquid separator 17 is withdrawn from anolyte gas-liquid separator 17 via conduit 33 and is sent via conduit 32 to anolyte cooler 13. Between conduits 33 and 32, the anolyte recirculation pump 15 is arranged to recirculate the anolyte between the anode section 10 of the electrolysis cell stack 2, the anolyte gas-liquid separator 17, and the anolyte cooler 13. anolyte cooler 13, the oxygen depleted anolyte is cooled to a pre-determined set temperature and then sent via conduit 31 to the anode section 10 of the electrolysis cell stack 2 for renewed electrochemical water splitting and formation of oxygen at the cathode 8.

If there is also a high demand on the purity of the oxygen to be produced, the anode side of the electrolysis arrangement can also be equipped with a corresponding anolyte deaerator, whereby said anolyte deaerator can also be operated with oxygen, in particular purified oxygen, to displace undesired gas components.

LIST OF REFERENCE SIGNS

1 electrolysis arrangement
2 electrolysis cell stack
3 rectifier

4 direct current
5 cathode
6 cathode compartment
7 cathode section
8 anode
9 anode compartment
10 anode section
11 membrane
12 catholyte cooler
13 anolyte cooler
14 catholyte recirculation pump
15 anolyte recirculation pump
16 catholyte gas-liquid separator
17 anolyte gas-liquid separator
18 catholyte deaerator
19 hydrogen cooler
20 oxygen cooler
21 hydrogen purification unit
22 conduit (hydrogen depleted catholyte)
23 conduit (hydrogen depleted catholyte)
24 conduit (hydrogen depleted catholyte)
25 conduit (hydrogen depleted catholyte)
26 conduit (hydrogen loaded catholyte)
27 conduit (hydrogen gas)
28 conduit (main stream purified hydrogen gas)
29 conduit (purified hydrogen gas stream to deaerator)
30 conduit (undesired gas components)
31 conduit (oxygen depleted anolyte)
32 conduit (oxygen depleted anolyte)
33 conduit (oxygen depleted anolyte)
34 conduit (oxygen loaded anolyte)
35 conduit (oxygen gas)

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for producing hydrogen and oxygen by electrolysis of an alkaline electrolysis medium, in which the hydrogen so produced comprises an Argon content of less than 50 ppb (v/v), the method comprising the method steps of electrochemical splitting of water contained in the alkaline electrolysis medium by means of an electrolysis cell stack, whereby a hydrogen loaded catholyte withdrawn from a cathode section of the electrolysis cell stack and an oxygen loaded anolyte withdrawn from an anode section of the electrolysis cell stack are obtained;

supplying the hydrogen loaded catholyte to a catholyte gas-liquid separator to separate hydrogen from the hydrogen loaded catholyte, whereby hydrogen gas and a hydrogen depleted catholyte are obtained;

supplying the oxygen loaded anolyte to an anolyte gas-liquid separator to separate oxygen from the oxygen loaded anolyte, whereby oxygen gas and an oxygen depleted anolyte are obtained;

withdrawing the hydrogen depleted catholyte from the catholyte gas-liquid separator, cooling the hydrogen depleted catholyte and supplying the hydrogen depleted catholyte to the cathode section of the electrolysis cell stack;

withdrawing the oxygen depleted anolyte from the anolyte gas-liquid separator, cooling the oxygen depleted anolyte and supplying the oxygen depleted anolyte to the anode section of the electrolysis cell stack;

degassing the hydrogen depleted catholyte withdrawn from the catholyte gas-liquid separator by means of a catholyte deaerating means, to thereby remove a catholyte dissolved Argon from the hydrogen depleted catholyte, and supplying the degassed hydrogen depleted catholyte to the electrolysis cell stack and/or degassing the oxygen depleted anolyte withdrawn from the anolyte gas-liquid separator by means of an anolyte deaerating means, to thereby remove an anolyte dissolved Argon from the oxygen depleted anolyte, and supplying the degassed oxygen depleted anolyte to the electrolysis cell stack, wherein an amount of dissolved Argon so removed results in the hydrogen having the Argon content of less than 50 ppb (v/v).

2. The method according to claim 1, wherein the alkaline electrolysis medium is a concentrated lye solution.

3. The method according to claim 1, wherein the degassing of the hydrogen depleted catholyte and/or the degassing of the oxygen depleted anolyte is carried out before cooling of the hydrogen depleted catholyte and the oxygen depleted anolyte.

4. The method according to claim 1, wherein the hydrogen gas separated in the catholyte gas-liquid separator is withdrawn from said gas-liquid separator and supplied to a hydrogen purification unit for removal of water and oxygen, to obtain a purified hydrogen gas.

5. The method according to claim 1, wherein the degassing of the hydrogen depleted catholyte is effected by introducing hydrogen gas into the hydrogen depleted catholyte.

6. The method according to claim 1 wherein the degassing of the hydrogen depleted catholyte is affected by introducing purified hydrogen gas into the hydrogen depleted catholyte, wherein the hydrogen gas separated in the catholyte gas-liquid separator is withdrawn from said gas-liquid separator and supplied to a hydrogen purification unit for removal of water and oxygen, to obtain a purified hydrogen gas.

7. The method according to claim 1, wherein the degassing of the oxygen depleted anolyte is effected by introducing oxygen gas into the oxygen depleted anolyte.

8. The method according to claim 1, wherein the degassing of the hydrogen depleted catholyte and/or the degassing of the oxygen depleted anolyte is effected by heating the hydrogen depleted catholyte and/or the oxygen depleted anolyte.

* * * * *